US005494636A

United States Patent [19]

Dupoiron et al.

[11] Patent Number: 5,494,636

[45] Date of Patent: Feb. 27, 1996

[54] AUSTENITIC STAINLESS STEEL HAVING HIGH PROPERTIES

[75] Inventors: Francois Dupoiron, Le Creusot; Jean-Christophe Gagnepain, Lyon; Richard Cozar, La Fermette; Bernard Mayonobe, Nevers, all of France

[73] Assignees: Creusot-Loire Industrie; Tecphy, both of Puteaux, France

[21] Appl. No.: 318,993

[22] Filed: Oct. 6, 1994

[30] Foreign Application Priority Data

Oct. 21, 1993 [FR] France ..... 93 12578

[51] Int. Cl.[6] ..... C22C 38/44; C22C 30/00

[52] U.S. Cl. ..... 420/586.1; 420/46; 420/59

[58] Field of Search ..... 420/586.1, 59, 420/65, 66, 46

[56] References Cited

U.S. PATENT DOCUMENTS

| | | | |
|---|---|---|---|
| 3,165,400 | 1/1965 | Roy et al. | 420/66 |
| 3,969,109 | 7/1976 | Tanczyn | 420/66 |

FOREIGN PATENT DOCUMENTS

| | | |
|---|---|---|
| 0342574 | 11/1989 | European Pat. Off. . |
| 411569 | 2/1991 | European Pat. Off. . |
| 0438992 | 7/1991 | European Pat. Off. . |
| 545753 | 6/1993 | European Pat. Off. . |
| 566814 | 10/1993 | European Pat. Off. . |
| 2705689 | 2/1994 | France . |

*Primary Examiner*—Deborah Yee
*Attorney, Agent, or Firm*—Cushman, Darby & Cushman

[57] ABSTRACT

The invention provides a steel containing by weight 23% ≦Cr≦28%; 15%≦Ni≦28%; 0.5%≦Mn≦6%; 3%≦Mo≦8%; 0.35%≦N≦0.8%; and 1%≦W≦5%. The steel has a high resistance to corrosion and may be used for manufacturing massive parts for any application, in particular for manufacturing equipment for oil platforms and chemical works, containers for transporting corrosive products, ship hulls and ply sheets.

14 Claims, No Drawings

AUSTENITIC STAINLESS STEEL HAVING HIGH PROPERTIES

1. Field of the Invention

The present invention relates to an austenitic stainless steel having high strength, high resistance to corrosion and a very good structural stability.

2. Background of the Invention

For the manufacture of equipment intended in particular for smoke depolluting installations, oil well platforms, the chemical industry, the paper pulp industry, there are employed austenitic or superaustenitic stainless steels having high strength and a high resistance to corrosion. These stainless steels generally contain high proportions of nitrogen and molybdenum. Such steels have been disclosed in particular in two European patents: EP-A-0,438,992 and EP-A-0,342,574 and in the French patent application FR-93-06468. But these steels have the drawback of a certain incompatibility between a good behaviour with respect to corrosion and a good structural stability. Consequently, there is for example a certain difficulty in conciliating the operations for manufacturing equipment, such as welding or hot forming, and a very high resistance to corrosion of all of the parts of this equipment.

Austenitic stainless steels having high strength and high resistance to corrosion known in the art have another drawback in that they cannot be used in the form of massive parts. Indeed, in the course of the cooling of the parts, the instability of the structure causes intermetallic precipitations which very markedly adversely affect the resistance to corrosion and the mechanical properties of the steel.

SUMMARY OF THE INVENTION

An object of the present invention is to provide an austenitic stainless steel having high mechanical properties, a very high resistance to corrosion in a chlorinated medium, and a very good structural stability.

For this purpose, the invention provides an austenitic stainless steel having high mechanical properties, high resistance to corrosion, and a high structural stability, the chemical composition of which comprises, by weight:

$0.35\% \leqq N \leqq 0.8\%$ $1\% \leqq W \leqq 5\%$ and at the most 6% Mn.

Preferably, the chemical composition of the steel comprises by weight:

$23\% \leqq Cr \leqq 28\%$ $15\% \leqq Ni \leqq 28\%$ $0.5\% \leqq Mn \leqq 6\%$ $0\% \leqq Cu \leqq 5\%$ $0\% \leqq C \leqq 0.06\%$ $0\% \leqq Si \leqq 1\%$ $0\% \leqq Nb \leqq 0.5\%$ $0\% \leqq V \leqq 0.5\%$ $0\% \leqq Al \leqq 0.1\%$ $3\% \leqq Mo \leqq 8\%$ $0.35\% \leqq N \leqq 0.8\%$ $1\% \leqq W \leqq 5\%$ the remainder consisting of iron and impurities related to the preparation. Still more preferentially, the chemical composition of the steel comprises by weight:

$23\% \leqq Cr \leqq 26\%$ $21\% \leqq Ni \leqq 23\%$ $2\% \leqq Mn \leqq 3.5\%$ $1\% \leqq Cu \leqq 2\%$ $0\% \leqq C \leqq 0.03\%$ $0\% \leqq Si \leqq 0.4\%$ $0\% \leqq Nb \leqq 0.5\%$ $0\% \leqq Al \leqq 0.1\%$ $4.5\% \leqq Mo \leqq 6.5\%$ $0.4\% \leqq N \leqq 0.55\%$ $2\% \leqq W \leqq 3.5\%$ the remainder consisting of iron and impurities related to the preparation.

Preferably, the chemical composition of the steel according to the invention satisfies the following formula:

$$CP=20\times\%CR+0.3\times\%Ni+30\times\%Si+40\times\%Mo+5\times\%W+10\times\%W+10\times\%Mn+50\times\%C-200\times\%N<710$$

which ensures that the kinetics of the precipitation of the intermetallic phases will be as slow as possible.

Moreover, in order to obtain the best possible resistance to corrosion, the chemical composition of the steel must correspond to the following:

$$PRENW=$$

$$Cr+3.3\times\%Mo+16\times\%N+1.7\%W>47.$$

Lastly, in order to obtain very high mechanical properties, the chemical composition of the steel must preferably satisfy the relation: 113+16 (% Mo+0.7% W)+525% N>420.

According to the invention, this steel may be used for manufacturing massive parts. It may also be used for manufacturing equipment for massive oil platforms or for manufacturing equipment for chemical works, paper pulp works, depolluting installations, or for manufacturing containers for transporting corrosive products, or lastly for manufacturing ship hulls. This steel may also be employed for manufacturing ply or claded sheets.

DETAILED DESCRIPTION OF PREFERRED EMBODIMENTS

The invention will now be described in detail in a non-limitative manner.

Those skilled in the art know austenitic stainless steels which are iron-base alloys, have a high chromium and nickel content and have a naturally austenitic structure in the solid state substantially at any temperature. For most of these steels, the structure is not 100% austenitic at around the solidification point but becomes so as soon as the temperature drops. For some of these steels, termed superaustenitic steels, the structure is 100% austenitic upon solidification. These steels are considered to be known.

The inventors have noticed that, surprisingly, by simultaneously adding to these steels high contents of nitrogen: 0.35% by weight to 0.8% by weight, and preferably 0.4% to 0.55%, and of tungsten: 1% by weight to by weight, and preferably 2% to 3.5%, there were obtained at once high mechanical properties, a very high resistance to corrosion in a chlorinated medium and a very good structural stability, i.e. a very slow kinetics of precipitation of intermetallic phases at elevated temperature.

A very good structural stability permits manufacturing massive parts, for example: thick sheets, thick tubes, forged parts, moulded parts or welded assemblies of which the mechanical properties and the behaviour with respect to corrosion are at every point excellent including in the vicinity of welds.

It is preferable that these steels contain by weight, in addition to the nitrogen and the tungsten in the aforementioned contents, the elements indicated below.

Chromium: more than 23% so as to ensure a good resistance to localized corrosion and a good solubility of the nitrogen, but less than 28% and preferably less than 26% so as to limit the risks of precipitation of chromium carbides.

Nickel: more than 15% and preferably more than 21% so as to ensure an austenitic solidification which guarantees a good solubility of the nitrogen so as to obtain a good resistance to corrosion in a sulphuric medium and limit the propagation of the localized corrosion, less than 28% and preferably less than 23% so as to avoid excessively reducing the solubility of the nitrogen and because nickel is an expensive metal.

Manganese: more than 0.5% and preferably more than 2% so as to obtain sufficient solubility of the nitrogen and limit the susceptibility to cracking in the hot state, less than 6% and preferably less than 3.5% so as to limit the risks of precipitation of intermetallic phases and limit the wear of the refractories in the course of the preparation of the steel.

Copper: 0% to 5% and preferably 1% to 2% so as to improve the resistance to corrosion in a sulphuric and an acid chlorinated medium.

Molybdenum: the content by weight of molybdenum of the steel must be more than 3% and preferably more than 4.5% so as to improve the resistance to localized corrosion, the solubility of the nitrogen, the mechanical properties at room temperature and at elevated temperature and limit the risks of cracking in the hot state upon welding; but this content must be less than 8% and preferably less than 6.5% so as to avoid formation of segregations and precipitation of intermetallic phases.

The functions of the nitrogen and tungsten are the following:

The nitrogen permits obtaining high mechanical properties, a good behaviour as concerns localized corrosion, a good structural stability; however, in excess it deteriorates the resilience.

The tungsten permits obtaining a good resistance to corrosion in acid and reducing chlorinated media, a good resistance to corrosion in splits when it is associated with molybdenum and nitrogen, reinforcing the mechanical properties at room temperature and elevated temperature; however, in excess, it causes precipitations which have an adverse effect on the properties of use.

Such steels always contain a little carbon, silicon and aluminium. The carbon content must be less than 0.06% and preferably less than 0.03% in order to avoid precipitation of carbide in the grain joints.

The silicon and aluminium which acted as deoxidizers in the course of the preparation of the steel are limited to 1% for the silicon and 0.1% for the aluminium.

Other elements such as magnesium, cerium or calcium may be added as deoxidizing agents. It is also possible to add up to 0.5% niobium and/or vanadium to improve the mechanical properties. In order to ensure that the properties of the stainless steel according to the invention are optimum, the chemical composition must be adjusted to be within such composition ranges that:

the mechanical properties are high, for which the following relation is required:

$$113+16\ (\%\ Mo+0.7\%\ W)+525\%\ N>420$$

the resistance to localized corrosion is maximum, for which the following is required:

$$PRENW=$$
$$Cr+3.3(\%\ Mo)+16\ (\%\ N)+1.7\ (\%\ W)>47$$

the kinematics of the precipitation of the intermetallic phases is very slow, which is obtained if:

$$CP=20$$
$$Cr+0.3$$
$$Ni+30\times\%Si+40\times\%Mo+5\times\%W+10\times\%Mn+50\times\%C-200\times\%N<710$$

With this chemical composition an austenitic stainless steel is obtained whose yield point Rp 0.2 % at room temperature is higher than 420 MPa and whose structural stability characterized by the kinematics of the precipitation of intermetallic phases at 850° C. is higher than those of grades which are otherwise equivalent. Consequently, the resistance to corrosion is unaffected by a thermal cycle employed in the use of the metal such as welding, which is not the case of steels of the prior art.

As an example, a steel having the following chemical composition was prepared:

| | |
|---|---|
| Cr = 23.7% | C = 0.015% |
| Ni = 21.5% | Mn = 2% |
| Mo = 5% | Si = 0.2% |
| N = 0.45% | Nb = 0.02% |
| W = 2% | V = 0.15% |
| Cu = 1.5% | Al = 0.02% |

This steel has a yield point of 452 MPa, a coefficient of sensitivity to corrosion by PRENW prick=50.8 and a coefficient of sensitivity to precipitations CP=627 so that the incubation time for the precipitation of intermetallic compounds at 850° C. is 180 sec.

After hyperquenching, the rate of corrosion in a hydrochloric medium is 100 MDD (mg/dm$^2$/day); after hyperquenching followed by a sensitization treatment by maintaining the steel at 800° C. for 15 min, the rate of corrosion under the same conditions is 200 MDD.

In comparison, a steel of the prior art having the following composition:

| | | |
|---|---|---|
| Cr = 24 | Mn = 3 | Si = 0.4 |
| Ni = 22 | C = 0.01 | Al = 0.02 |
| Mo = 7 | Nb = 0.2 | |
| N = 0.45 | V = 0.15 | |

has a yield point of 461 MPa, a PRENW=54.3, a CP=716, an incubation time for the precipitation of 60 sec, a rate of corrosion after hyperquenching of 99 MDD and a rate of corrosion after a sensitization treatment at 850° C. for 15 min of 980 MDD.

The steel according to the invention is much less sensitive to the sensitization thermal cycles. Consequently, it is possible to produce ply or claded sheets constituted by a layer of steel according to the invention and a layer of structural steel whose stainless plating properties are comparable to the properties of a massive stainless steel sheet produced from the same grade.

As the steel according to the invention has a high structural stability it can be used for manufacturing in particular moulded parts, forged parts, rolled bars, rolled sheets, shapes, weld-less tubes and welded tubes, in particular when these objects are massive, i.e. when they are employed in the form of thick parts, i.e. parts having a minimum thickness greater than 4 mm, in particular when it concerns parts having a thickness exceeding 4 mm and less than 40 mm;

they then have a good homogeneity of the properties within the thickness; as concerns thicknesses exceeding 40 mm, the very good structural stability permits retaining high levels of resilience and ductility within the thickness.

Owing to its mechanical properties, its resistance to corrosion, its aptitude for welding and the manufacture of thick parts, the steel according to the invention may be used advantageously in particular for manufacturing:

tubes, flanges, collectors, oil pipelines, gas pipelines, separators, pumps, compressors, exchangers adapted to be used in contact with sea water or fluids containing chlorides and $H_2S$, in particular for any equipment for firefighting processes or circuits conducting sea water on marine oil platforms, tubes, flanges, tanks, reactors, pumps, compressors and more generally any part or wall of equipment for the chemical industry, for manufacturing paper pulp, hydrometallurgy, depollution operating in contact with fluids or corrosive effluents and in particular when it concerns corrosion by acid chlorinated media; concerned in the paper pulp industry are in particular chlorination filters, whitening towers, in particular, whitening towers with oxygen peroxide and ozone, mixers, washers, impregnators, tanks for road, rail or maritime transport of corrosive products, hulls of ships, equipment operating at elevated temperature and in particular equipment for the petrochemical industry, cement industry, incineration of garbage, smoke flues, chimney stacks.

These applications are not intended to be exhaustive and more generally this steel permits obtaining an improved behaviour in service over steels of the prior art and at a lower cost than with nickel-base alloys for all the applications:

in an oxidizing chlorinated medium, in a medium containing chlorides and $H_2S$, in an acid chlorinated medium, in particular when the parts produced must be thick or massive or when the temperature of utilization is elevated.

What is claimed is:

1. Austenitic stainless steel having high mechanical properties, high resistance to corrosion and a high structural stability, and a chemical composition comprising by weight:

$23\% \leqq Cr \leqq 28\%$;

$15\% \leqq Ni \leqq 28\%$;

$0.5\% \leqq Mn \leqq 6\%$;

$0\% \leqq Cu \leqq 5\%$;

$0\% \leqq C \leqq 0.06\%$;

$0\% \leqq Si \leqq 1\%$;

$0\% \leqq Nb \leqq 0.5\%$;

$0\% \leqq V \leqq 0.5\%$;

$0\% \leqq Al \leqq 0.1\%$;

$3\% \leqq Mo \leqq 8\%$;

$0.35\% \leqq N \leqq 0.8\%$;

$1\% \leqq W \leqq 5\%$; and the remainder being iron and impurities related to the preparation thereof.

2. An austenitic stainless steel according to claim 1, wherein the amount of Cr is less than 26% by weight.

3. An austenitic stainless steel according to claim 1, wherein the amount of Ni is more than 21% by weight but less than 23% by weight.

4. An austenitic stainless steel according to claim 1, wherein the amount of Mn is more than 2% by weight and less than 3.5% by weight.

5. An austenitic stainless steel according to claim 1, wherein the amount of Cu is more than 1% by weight and less than 2% by weight.

6. An austenitic stainless steel according to claim 1, wherein the amount of C is less than 0.03% by weight.

7. An austenitic stainless steel according to claim 1, wherein the amount of Si is less than 0.4% by weight.

8. An austenitic stainless steel according to claim 1, wherein the amount of Mo is more than 4.5% by weight and less than 6.5% by weight.

9. An austenitic stainless steel according to claim 1, wherein the amount of N is more than 0.4% by weight and less than 0.55% by weight.

10. An austenitic stainless steel according to claim 1, wherein the amount of W is more than 2% by weight and less than 3.5% by weight.

11. Stainless steel according to claim 1, wherein its chemical composition comprises by weight:

$23\% \leqq Cr \leqq 26\%$ $21\% \leqq Ni \leqq 23\%$ $2\% \leqq Mn \leqq 3.5\%$ $1\% \leqq Cu \leqq 2\%$ $0\% \leqq C \leqq 0.03\%$ $0\% \leqq Si \leqq 0.4\%$ $0\% \leqq Nb \leqq 0.5\%$ $0\% \leqq Al \leqq 0.1\%$ $4.5\% \leqq Mo \leqq 6.5\%$ $0.4\% \leqq N \leqq 0.55\%$ $2\% \leqq W \leqq 3.5\%$ the remainder being constituted by iron and impurities relating to the preparation.

12. Stainless steel according to claim 1, wherein its chemical composition satisfies the following relation:

$$CP=20\times\%Cr+0.3\times\%Ni+30\times\%Si+40\times\%Mo+5\times\%W+10\times\%Mn+50\times\%C-200\times\%N<710.$$

13. Stainless steel according to claim 12, wherein its chemical composition satisfies the following relation:

$$PRENW=CR+3.3\times\%Mo+1.6\times\%N+1.7\%W>47.$$

14. Stainless steel according to claim 13, wherein its chemical composition satisfies the following relation:

$$113+16\ (\%\ Mo+0.7\%\ W)+525\%\ N>420.$$

* * * * *